US006908329B2

(12) United States Patent
Kozono et al.

(10) Patent No.: US 6,908,329 B2
(45) Date of Patent: Jun. 21, 2005

(54) ENGAGEMENT DETECTING STRUCTURE IN CONNECTOR

(75) Inventors: Seiji Kozono, Shizuoka (JP); Toshinori Yamamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/083,574

(22) Filed: Feb. 27, 2002

(65) Prior Publication Data

US 2002/0119695 A1 Aug. 29, 2002

(30) Foreign Application Priority Data

Feb. 27, 2001 (JP) ..... P.2001-052488

(51) Int. Cl.[7] ..... H01R 13/627
(52) U.S. Cl. ..... 439/352; 439/489
(58) Field of Search ..... 439/488, 489, 439/350, 352, 354, 357, 358

(56) References Cited

U.S. PATENT DOCUMENTS 5,120,255 A * 6/1992 Kouda et al. ..... 439/489
5,605,471 A * 2/1997 Plyler ..... 439/489
5,681,178 A * 10/1997 Kunkle et al. ..... 439/352
5,688,142 A * 11/1997 Dietz et al. ..... 439/489
6,024,595 A * 2/2000 Saba et al. ..... 439/489
6,102,726 A 8/2000 Tsuji et al.
6,116,939 A 9/2000 Fukuda
6,186,819 B1 2/2001 Holub
6,261,115 B1 * 7/2001 Pederson et al. ..... 439/352

FOREIGN PATENT DOCUMENTS

JP 10-177880 6/1998

* cited by examiner

*Primary Examiner*—Hien Vu
(74) *Attorney, Agent, or Firm*—Sughrue Mion, PLLC

(57) ABSTRACT

In a connector, a first housing is provided with a projection, and a second housing is provided with a retainer engaged with the projection. An engagement detector is held in the second housing so as to slidable between a first position and a second position. The retainer retains the engagement detector at the first position such that the engagement detector is slidable to the second position only when the projection and the retainer are completely engaged with each other at a complete engagement position. The engagement detector locks the retainer at the complete engagement position when the engagement detector is placed in the second position.

7 Claims, 8 Drawing Sheets

ENGAGEMENT DETECTING STRUCTURE IN CONNECTOR

BACKGROUND OF THE INVENTION

The present invention relates to a connector wherein it is detected whether or not a pair of connector housings which are engaged with each other are in a complete engagement state.

Connectors have been widely used for simply effecting mechanical engagement and electrical connection. Although these connectors are easy to handle, there are cases where they are left as they are in a half engagement state. When they happen to disengage from each other, or electrical connection becomes incomplete accidentally, there has been a probability of causing the malfunction of the equipment. Accordingly, there have been proposed numerous connectors which are able to confirm that firm mechanical engagement has been effected reliably.

For example, in Japanese Patent Publication No. 10-177880A, a connector is proposed which facilitates the attachment or detachment of a connector housing, which makes it possible to easily confirm that mechanical engagement has been effected reliably, and which prevents the connector housing from disengaging due to careless or erroneous operation.

In the related connector, however, since a member for engaging the pair of connector housings, a member for preventing the disengagement due to careless or erroneous operation, and a member for retaining the disengagement preventing action are separately provided, the structure is made complex, and the size of the connector is made large. In addition, due to the complex structure, an expensive molding die is required for the mass production of connectors, so that it is difficult to lower the total manufacturing cost.

SUMMARY OF THE INVENTION

It is therefore an object of the invention is to provide a connector with a simple and compact structure to lower the total manufacturing cost.

In order to achieve the above object, according to the present invention, there is provided a connector, comprising:

a first housing, provided with a projection;

a second housing, provided with a retainer engaged with the projection; and an engagement detector, held in the second housing so as to slidable between a first position and a second position, wherein:

the retainer retains the engagement detector at the first position such that the engagement detector is slidable to the second position only when the projection and the retainer are completely engaged with each other at a complete engagement position; and the engagement detector locks the retainer at the complete engagement position when the engagement detector is placed in the second position.

Namely, although the engagement detector is held in the second housing so as to be slidable between the first position and the second position, the manner of interference between the engagement detector and the retainer changes depending on the state of engagement between the projection and the retainer (that is, the first and second housings), so that the engagement detector is placed in the first position or the second position.

Accordingly, in the course of the engagement of the housings, the engagement detector is held in the first position, so that it is possible to visually confirm that the housings are in the half engagement state. After completion of the engagement, the engagement detector can be moved to and held in the second position, so that it is possible to visually confirm that the housings are in the complete engagement state.

Preferably, the connector further comprises a lock canceller which is manipulated to move the retainer so as to cancel the complete engagement with the projection.

Here, it is preferable that the retainer is still locked at the complete engagement position by the engagement detector in a case where the lock canceller is manipulated when the engagement detector is placed in the second position.

According to the above configuration, it is possible to prevent the housings from being disengaged due to careless or erroneous operation of the lock canceller. Since the retainer serves not only as an engagement member but also as an assisting member for the visual confirmation of the engagement state, and since the engagement detector serves not only as an assisting member for the visual confirmation of the engagement state but also as an engagement retaining member, it is possible to simplify the structure of the connector housings, make the connector housings compact, and lower the cost.

Preferably, the second housing is formed with a stopper which prevents the lock canceller from being manipulated excessively.

Alternatively, the lock canceller may be formed with a stopper which prevents the lock canceller from being manipulated excessively.

In any of the above configurations, the plastic deformation or the like due to the excess manipulation of the lock canceller can be avoided.

Preferably, the second housing includes a cover portion which covers the complete engagement position.

In this configuration, the complete engagement position can be protected from an external force so that the housings are prevented from being disengaged accidentally.

Here, it is preferable that the cover portion is formed with a notch which allows the engagement detector to move therein.

In this configuration, since the engagement detector is prevented from interfering with the cover portion, the operation of engaging or disengaging the housings is facilitated.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, a detailed description will be given of a connector according to one embodiment of the invention.

Figure 1A:
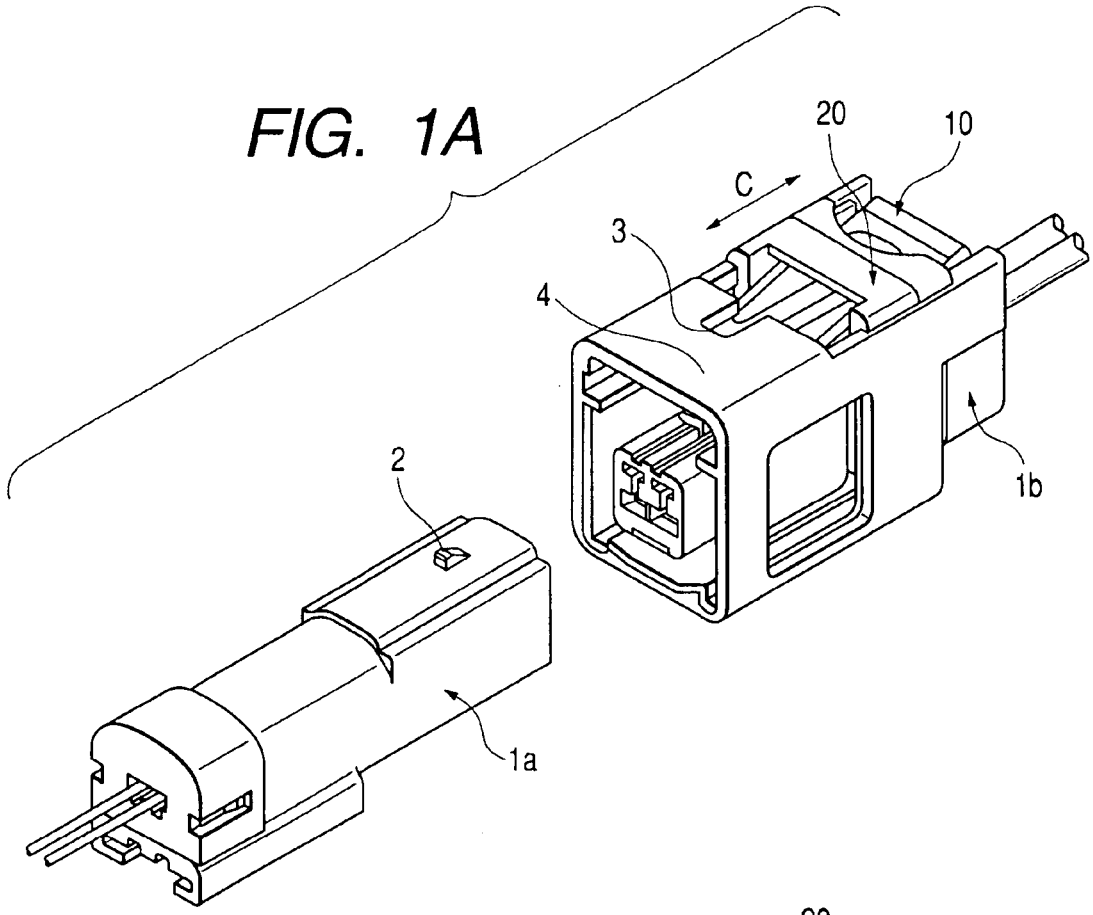
FIG. 1A is a perspective view illustrating the structure of a connector according to one embodiment of the invention.

As shown in FIG. 1A, a connector comprises: a first connector housing 1*a* provided with a locking projection 2; a second connector housing 1*b* provided with a locking member 10 having a locking retainer 11 to be engaged with the locking projection 2; and an engagement detector 20 for detecting a complete engagement state between the first connector housing 1*a* and the second connector housing 1*b*.

Figure 1B:
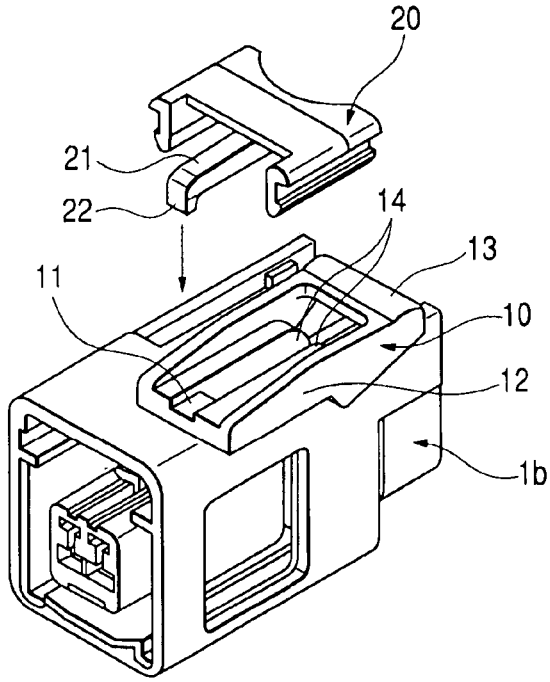
FIG. 1B is a partially exploded perspective view of a second connector housing shown in FIG. 1A.

As shown in FIG. 1B, the locking member 10 includes a locking arm 12 supported by a pair of supporters 14 in a cantilevered manner, on the second connector housing 1*b*. The locking retainer 11 is formed on a free end portion of the locking arm 12. The locking member 10 also includes a lock canceller 13 for canceling the engagement between the locking projection 2 and the locking retainer 11, or in other words, disengaging the locking projection 2 from the locking retainer 11.

The engagement detector 20 includes a detection arm 21 extending in a cantilevered manner. A detection hook 22 is formed on a free end portion of the detection arm 21 . The detection hook 22 is to be interfered with the locking retainer 11 for detecting an engagement state of the connector housings 1*a* and 1*b*. The engagement detector 20 is held in the second connector housing 1*b* so as to be slidable between a locked position and an engagement confirming position (in an arrow C direction) as described later.

In the state where the first and second connector housings 1*a* and 1*b* are completely engaged with each other, and the engagement detector 20 is held in the engagement confirming position, the rigidity of the detection arm 21 is set such that it is deflected to maintain the engagement between the locking projection 2 and the locking retainer 11 while the locking retainer 11 and the engagement detector 20 are interfering with each other, when the lock canceller 13 is manipulated.

Figure 2:
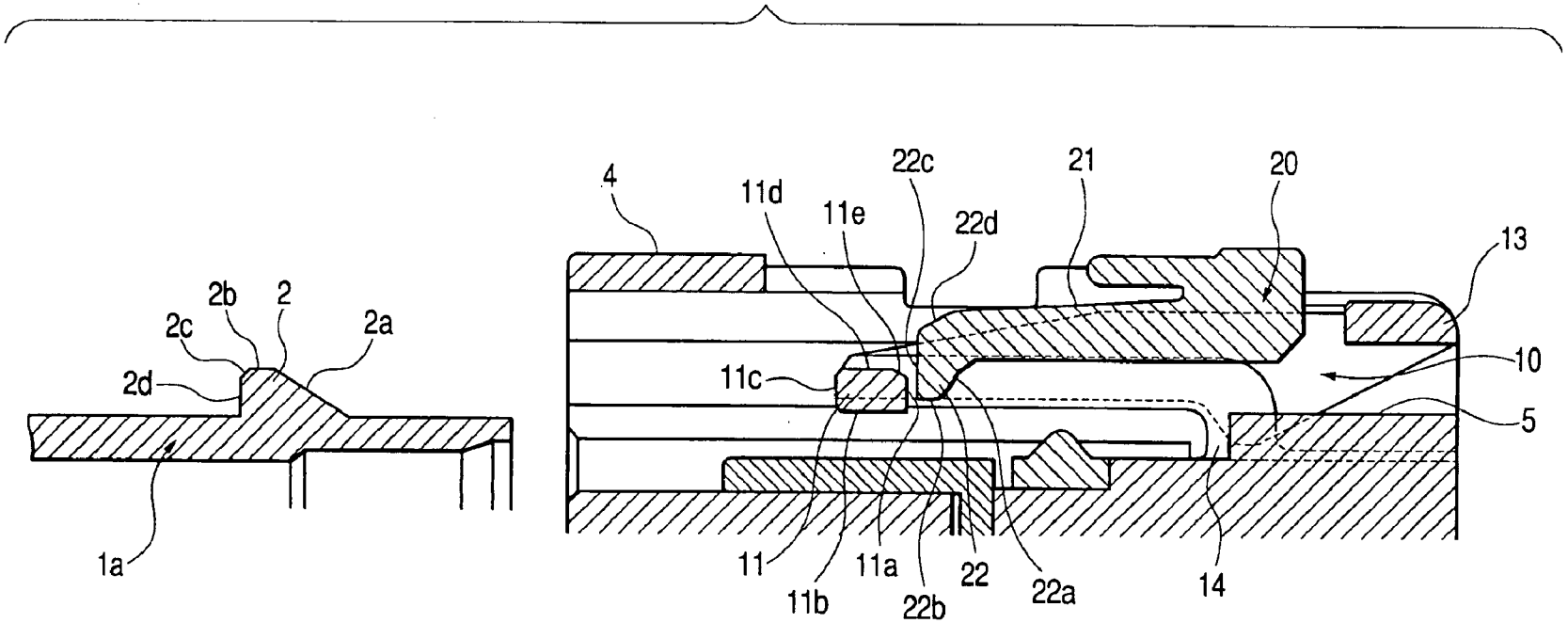
FIG. 2 is a side section view of first and second connector housings before engagement of the connector.

As shown in FIG. 1A, an outer wall of the second connector housing 1*b* is provided with a cover portion 4 for covering the engaging portion of the locking retainer 11 and the locking projection 2, and a notch 3 for avoiding the interference with the detection arm 21 is provided in this cover portion 4. As shown in FIG. 2, a manipulation stopper 5 is provided between the lock canceller 13 and the second connector housing 1*b* to prevent excess deformation of the lock canceller 13 when it is manipulated.

Before the engagement of the connector, as shown in FIG. 2, a first face 11*a* of the locking retainer 11 and a third face 22*c* of the engagement detector 20 interfere with each other, so that the engagement detector 20 is held in the locked position. In addition, since the engagement detector 20 is held in the locked position, the locking retainer 11 is movable in the vertical direction when the first connector housing 1*a* is inserted into the second connector housing 1*b*, so that the engagement detector 20 does not hamper the engagement between the first and second connector housings 1*a* and 1*b*.

Figure 3:
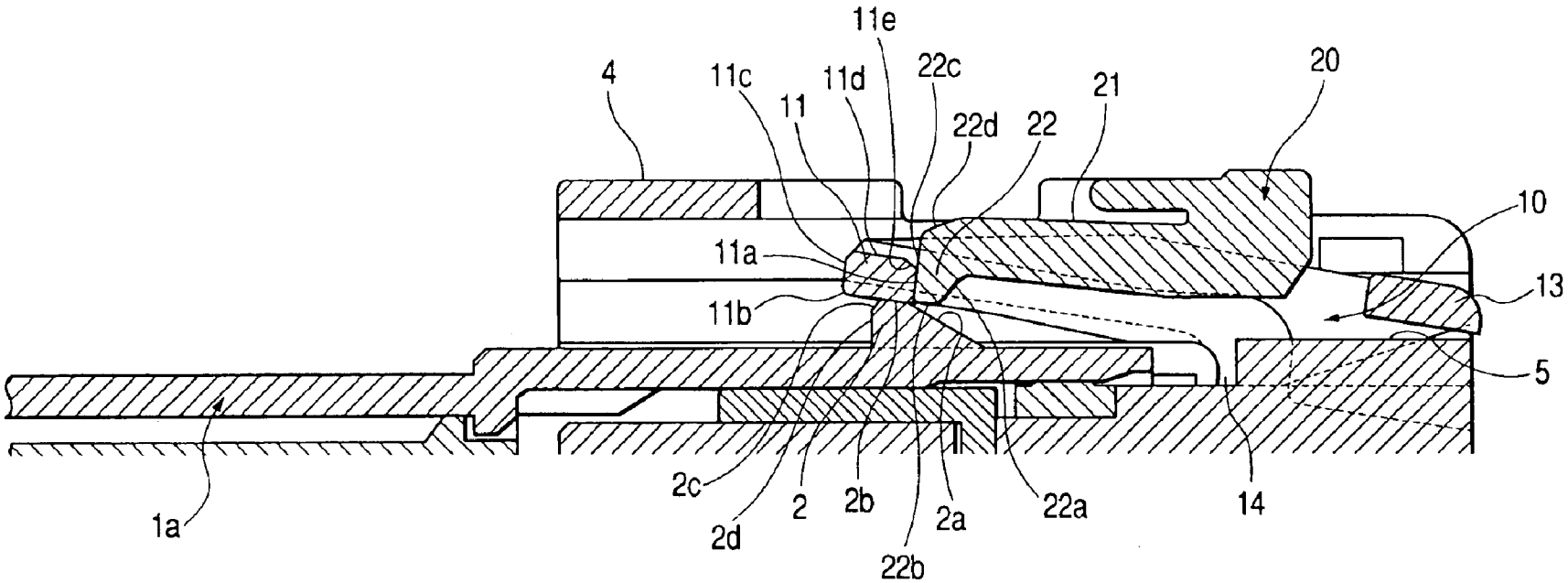
FIG. 3 is a side section view of the connector illustrating the state that the first and second connector housings are in the course of engagement.

When the first connector housing 1*a* is inserted into the second connector housing 1*b*, as shown in FIG. 3, a first face 2*a* of the locking projection 2 and a corner formed by second and third faces 11*b* and 11*c* of the locking retainer 11 interfere with each other. However, since the first face 2*a* of the locking projection 2 is sloped with respect to the inserting direction of the first connector housing 1*a*, the locking arm 12 undergoes flexible deformation, and the locking retainer 11 rides on the first face 2*a* of the locking projection 2. Here, to facilitate the riding of the locking retainer 11 on the first face 2*a* of the locking projection 2, the corner formed by the second and third faces 11*b* and 11*c* of the locking retainer 11 is rounded.

When the first connector housing 1*a* is further inserted into the second connector housing 1*b*, the first face 2*a* of the locking projection 2 and a corner formed by second and third faces 22*b* and 22*c* of the detection hook 22 also interfere with each other, so that the detection arm 21 undergoes flexible deformation, and the detection hook 22 rides on the first face 2*a* of the locking projection 2.

In this state as well, since the first face 11*a* of the locking retainer 11 and the third face 22*c* of the detection hook 22 interfere with each other, the engagement detector 20 is still held in the locked position.

Figure 4:
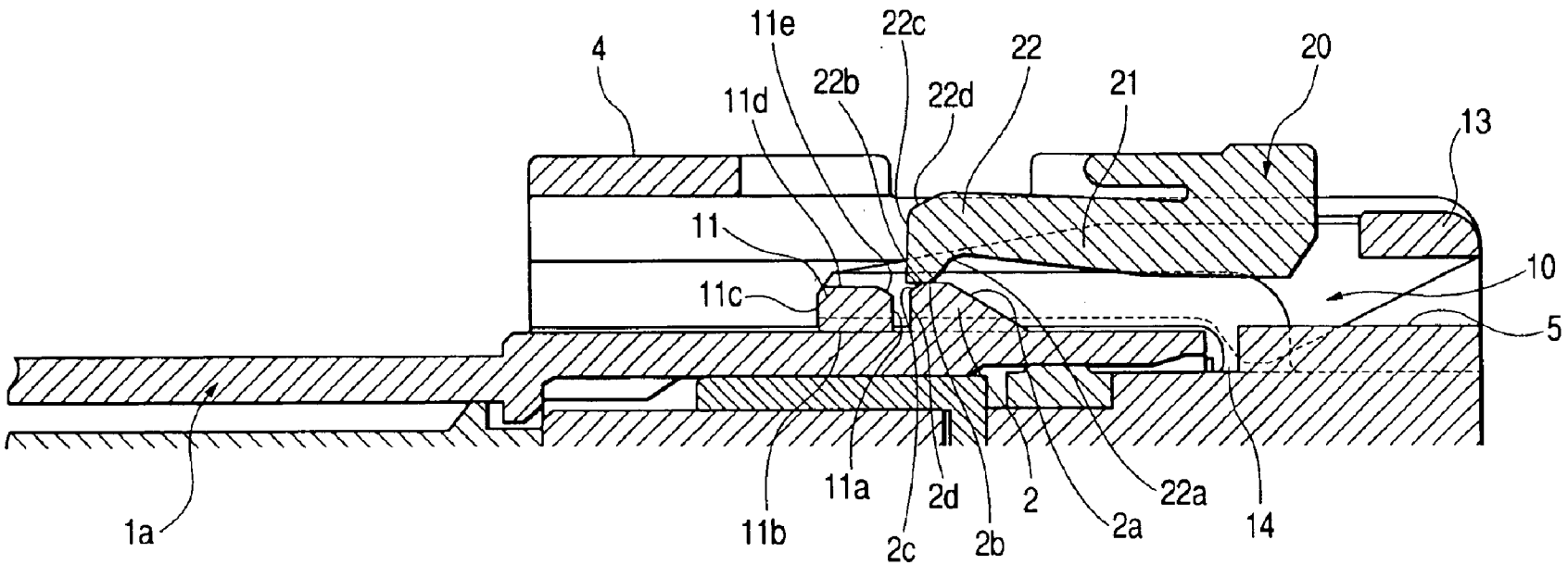
FIG. 4 is a side section view of the connector illustrating the first and second connector housings in a complete engagement state.

Immediately before the insertion of the first connector housing 1*a* is completed, as shown in FIG. 4, the locking retainer 11 rides over the locking projection 2, so that the flexible deformation of the locking arm 12 is canceled and the locking arm 12 resumes its original shape.

Through this operation, even if an attempt is made to pull out the first connector housing 1*a* from the second connector housing 1*b*, a fourth face 2*d* of the locking projection 2 and the first face 11*a* of the locking retainer 11 interfere with each other, so that the first connector housing 1*a* cannot be pulled out, thereby completing the engagement of the first and second connector housings 1*a* and 1*b*.

In a state where the engagement has been completed, the interference between the locking retainer 11 and the detection hook 22 is canceled, the detection arm 21 is flexibly deflected. And in a state where the detection hook 22 has ridden on a second face 2*b* of the locking projection 2 and a fourth face 11*d* of the locking retainer 11, the movement of the engagement detector 20 from the locked position to the engagement confirming position is made possible.

Rounding the corner formed by first and second faces 22*a* and 22*b* of the detection hook 22, and providing a third face 2*c* on the locking projection 2 and a fifth face 11*e* on the locking retainer 11 , the free movement of the detection hook 22 on the second face 2*b* of the locking projection 2 and the fourth face 11*d* of the locking retainer 11 is facilitated.

Figure 5:
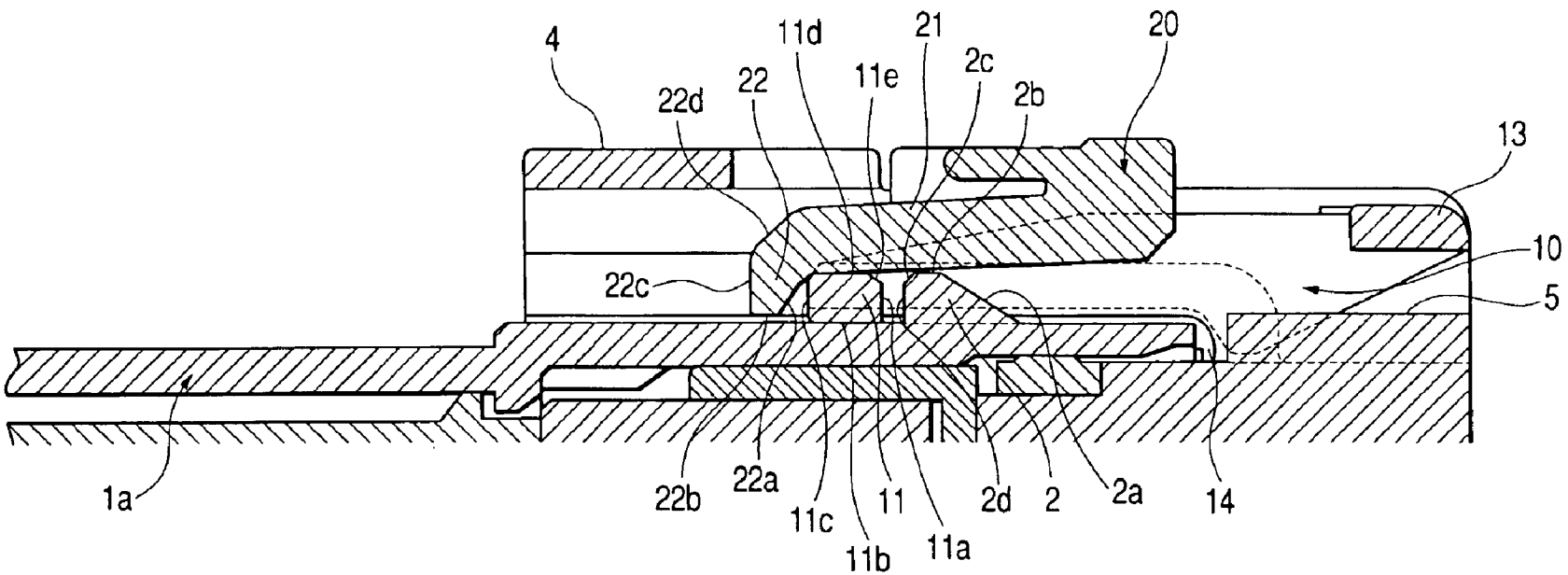
FIG. 5 is a side section view of the connector illustrating the first and second connector housings in a complete engagement state, wherein an engagement detector is placed in an engagement confirming position.

When the movement of the engagement detector 20 to the fitting confirming position is completed, as shown in FIG. 5, the detection hook 22 rides over the locking projection 2 and the locking retainer 11, so that the flexible deformation of the detection arm 21 is canceled.

Consequently, since the first face 22*a* of the detection hook 22 and a third face 11*c* of the locking retainer 11 interfere with each other, the detection hook 22 is caught by the locking retainer 11, so that the engagement detector 20 is held in the engagement confirming position.

Since the first face 22*a* of the detection hook 22 is sloped with respect to the third face 11*c* of the locking retainer 11, the detection hook 22 does not come off the locking retainer 11 even if vibrations are imparted to the connector or the connector is touched. However, in a case where an attempt is made to intentionally or forcibly move the engagement detector 20 to the locked position, the detection arm 21 undergoes flexible deformation and resumes the state shown in FIG. 4, thereby making it possible to move the engagement detector 20 to the locked position. Further, a corner formed by the third and fourth faces 11*c* and 11*d* of the locking retainer 11 is rounded, the movement of the engagement detector 20 held in the engagement confirming position to the locked position is facilitated.

According to the above configuration, since the engagement detector 20 cannot be moved to the engagement confirming position unless the engagement and locking of the connector are completed, it is possible to visually confirm the complete engagement and locking of the connector.

Figure 6:
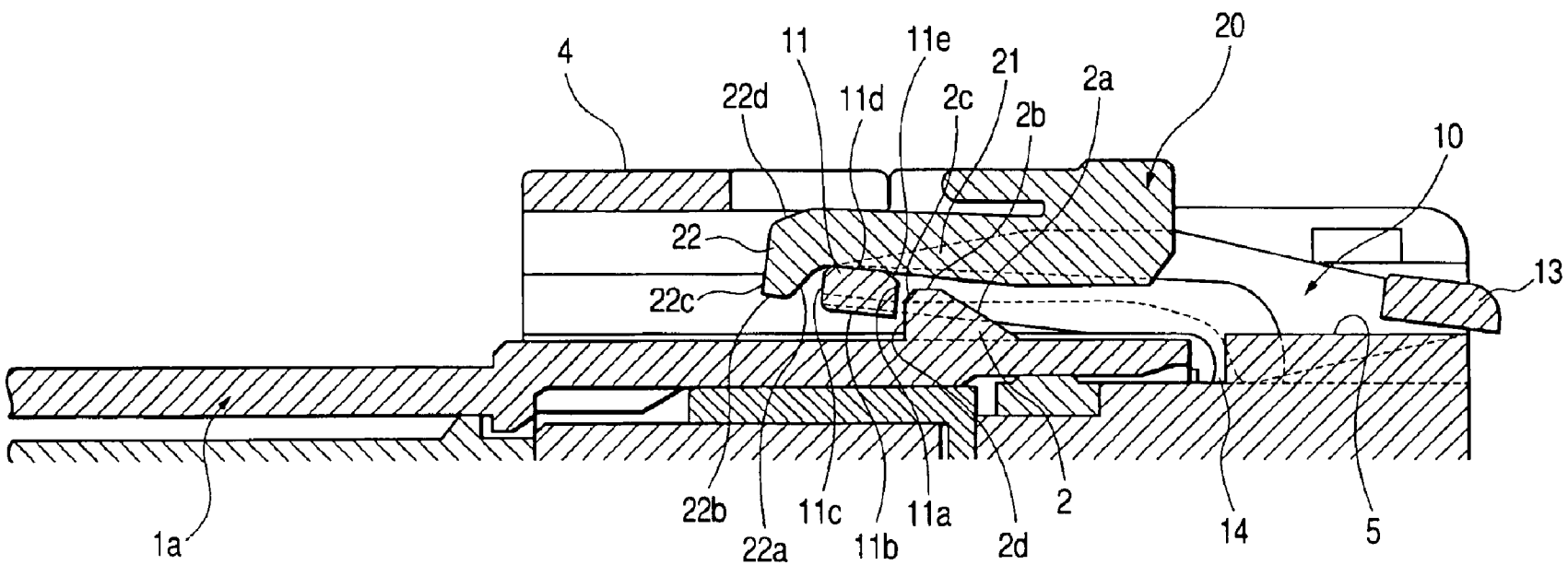
FIG. 6 is a side section view of the connector illustrating the state that a lock canceller is operated when the engagement detector is placed in an engagement confirming position.

When the engagement detector 20 is held in the engagement confirming position, even if the lock canceller 13 is manipulated as shown in FIG. 6, the detection arm 21 prevents the movement of the locking retainer 11. Hence, even if an attempt is made to pull out the first connector housing 1*a* from the second connector housing 1*b*, since the interference between the first face 11*a* of the locking retainer 11 and the locking projection 2 has not been canceled, the first connector housing 1*a* cannot be pulled out, thereby making it possible to prevent the connector from coming off due to careless or erroneous manipulation of the lock canceller 13.

Figure 7:
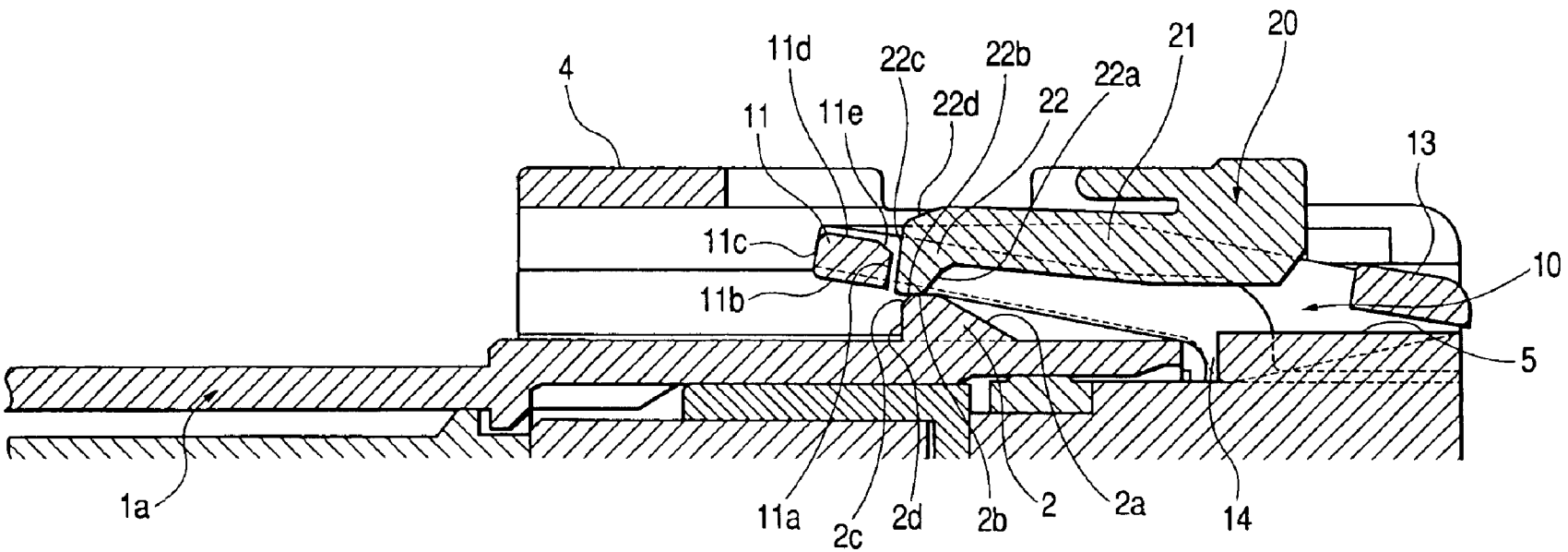
FIG. 7 is a side section view of the connector illustrating the first and second connector housings in the process of unlocking.

When the lock canceller 13 is manipulated after the engagement detector 20 is forcibly moved back to the locked position as shown in FIG. 7, the locking retainer 11 is moved to the position where it does not interfere with the locking projection 2, so that the interfere of the detection arm 21 with respect to the locking retainer 11 is canceled, the first connector housing 1*a* can be pulled out from the second connector housing 1*b*.

Figure 8A:
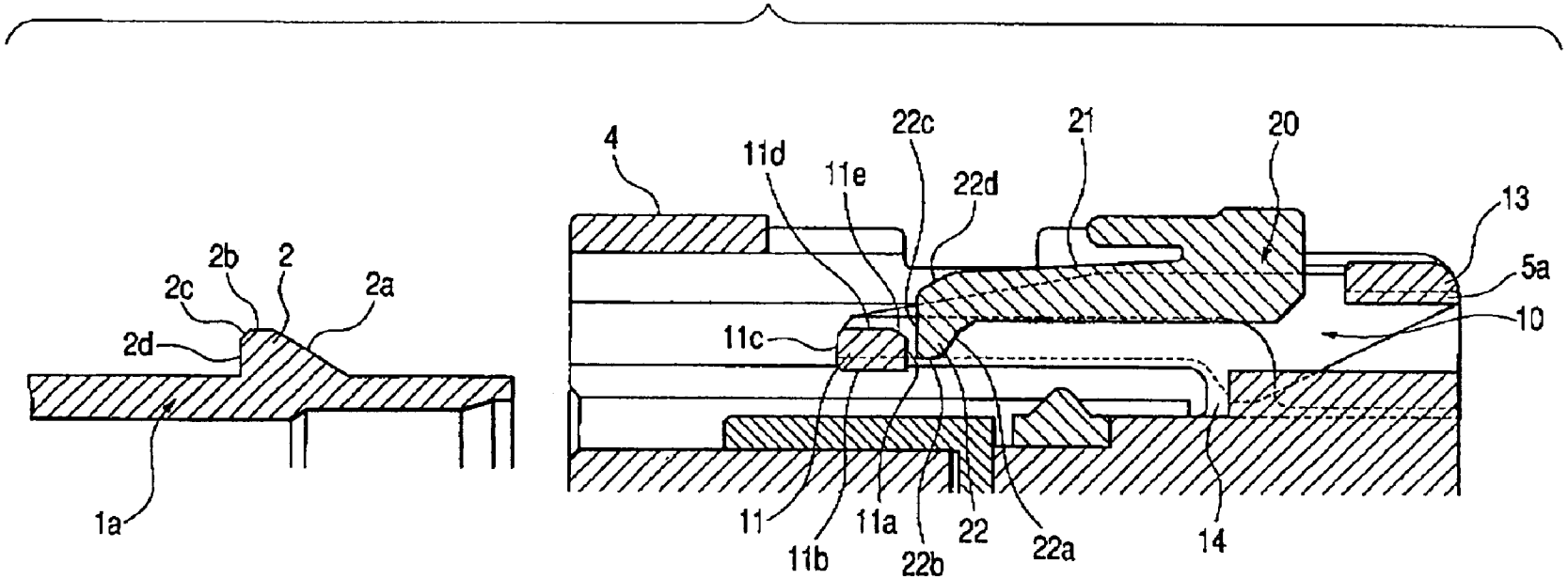
FIG. 8A is a side section view of the stopper formed on the lock canceller.
Figure 8B:
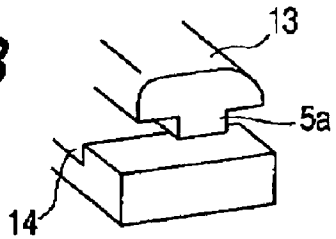
FIG. 8B is a perspective view showing the stopper formed on the lock canceller.

Here, since the manipulation stopper 5 is provided on the second connector housing 1*b*, even if the lock canceller 13 is manipulated excessively with careless, the supporters 14 will not undergo plastic deformation due to its excess displacement. However, as shown in FIGS. 8A and 8B, the stopper 5*a* can also be provided on the lock canceller 13.

It should be noted that the above-described embodiment has been described to facilitate an understanding of the invention, and does not limit the invention. Accordingly, the various elements shown in the above-described embodiment should be construed as including all selective matters of design belonging to the technical scope of the invention.

For example, contrary to the above embodiment, the first connector housing 1*a* may be provided with the locking member 10 and the engagement detector 20, and the second connector housing 1*b* may be provided with the locking projection 2. Further, two or more detection arms may be provided to improve the strength of engagement.

In other words, the invention need not be limited to the above-described embodiment insofar as the locking projection 2, the locking member 10, and the engagement detector 20 are designed such that: the engagement detector 20 cannot be moved from the locked position to the engagement confirming position unless the engagement and locking of the connector are completed; the engagement detector is held in the engagement confirming position by the detection hook 22; and the detection arm 21 prevents the movement of the locking retainer 11 at the engagement confirming position so as to prevent the connector from coming off.

What is claimed is:

1. A connector, comprising:

a first housing, provided with a projection;

a second housing, provided with a retainer which is operable to engage the projection of the first housing;

an engagement detector, held in the second housing and slidable between a first position and a second position; and a lock canceller, which is operable to disengage the retainer from the projection only when the engagement detector is placed at the first position, wherein:

the retainer prevents the engagement detector from sliding from the first position to the second position except when the projection and the retainer are completely engaged with each other at a complete engagement position;

the engagement detector locks the retainer at the complete engagement position when the engagement detector is placed at the second position; and the engagement detector and the retainer are moved to a third position at which the engagement detector is allowed to be forcibly moved to the first position, in a case where the lock canceller is manipulated when the engagement detector is placed at the second position;

wherein the engagement detector includes a detection hook, and the engagement detector is placed above the lock canceller.

2. The connector as set forth in claim 1, wherein the second housing includes a cover portion which covers the complete engagement position.

3. The connector as set forth in claim 2, wherein the cover portion is formed with a notch which allows the engagement detector to move therein.

4. The connector as set forth in claim 1, wherein the second housing further comprises a stopper which limits the range of movement of the lock canceller.

5. The connector as set forth in claim 1, wherein the lock canceller comprises a stopper which limits the range of movement of the lock canceller.

6. The connector as set forth in claim 4, wherein said stopper extends upwardly from an end of the second housing and is positioned between the lock canceller and the second housing.

7. A connector, comprising:

a first housing, provided with a projection;

a second housing, provided with a retainer which is operable to engage the projection of the first housing;

an engagement detector, held in the second housing and slidable between a first position and a second position; and a lock canceller, which is operable to disengage the retainer from the projection only when the engagement detector is placed at the first position, wherein:

the retainer prevents the engagement detector from sliding from the first position to the second position except when the projection and the retainer are completely engaged with each other at a complete engagement position;

the engagement detector locks the retainer at the complete engagement position when the engagement detector is placed at the second position;

the lock canceller is capable of being manipulated toward said second housing when the engagement detector is placed at said second position and the retainer is still locked by the engagement detector in a case where the lock canceller is manipulated toward said second housing when the engagement detector is placed at the second position;

wherein the engagement detector includes a detection hook, and the engagement detector is placed above the lock canceller.

* * * * *